US008517400B2

(12) United States Patent
Kim

(10) Patent No.: US 8,517,400 B2
(45) Date of Patent: Aug. 27, 2013

(54) STEERABLE TRAVELING TRUCK

(76) Inventor: Yun-Sik Kim, Seoul (KR)

( * ) Notice: Subject to any disclaimer, the term of this patent is extended or adjusted under 35 U.S.C. 154(b) by 226 days.

(21) Appl. No.: 13/124,932

(22) PCT Filed: Nov. 2, 2009

(86) PCT No.: PCT/KR2009/006396

§ 371 (c)(1),
(2), (4) Date: Apr. 19, 2011

(87) PCT Pub. No.: WO2010/056007

PCT Pub. Date: May 20, 2010

(65) Prior Publication Data

US 2012/0018963 A1 Jan. 26, 2012

(30) Foreign Application Priority Data

Nov. 11, 2008 (KR) ..... 10-2008-0111414

(51) Int. Cl.
*A45C 13/26* (2006.01)
*A45C 5/14* (2006.01)

(52) U.S. Cl.
CPC ..... *A45C 13/262* (2013.01); *A45C 5/14* (2013.01)
USPC ..... 280/47.11; 280/47.34; 280/47.371; 280/64

(58) Field of Classification Search
CPC ..... A45C 5/14; A45C 13/262
USPC ..... 280/47.11, 64, 47.34, 47.371, 655.1, 280/98; 180/19.1; 190/18 A
See application file for complete search history.

(56) References Cited

U.S. PATENT DOCUMENTS

| | | | | |
|---|---|---|---|---|
| 949,774 | A * | 2/1910 | Minnich | 280/47.11 |
| 5,339,934 | A | 8/1994 | Liang | |
| 5,964,471 | A * | 10/1999 | Copland | 280/47.11 |
| 6,135,465 | A * | 10/2000 | Chapman | 280/47.11 |
| 6,874,800 | B2 * | 4/2005 | George | 280/99 |
| 2007/0085285 | A1 * | 4/2007 | Lindsay | 280/47.34 |
| 2010/0066044 | A1 * | 3/2010 | Kim | 280/47.11 |

FOREIGN PATENT DOCUMENTS

| | | | |
|---|---|---|---|
| KR | 10-2001-0028666 | A | 4/2001 |
| WO | 2008071798 | A1 | 6/2008 |

* cited by examiner

*Primary Examiner* — John R Olszewski
*Assistant Examiner* — Brian Cassidy
(74) *Attorney, Agent, or Firm* — MKG, LLC

(57) ABSTRACT

In a steerable traveling trunk, a driving part is provided for converting a horizontal axis rotation of the handle into a vertical axis rotation at both ends of the handle and transferring the rotations as a user rotates the handle. A driving force transfer part is connected to the driving part and transfers rotational force of the driving part to a lower side of the traveling trunk body. An output part is connected to a lower side of the driving force transfer part and transfers rotational force depending on the rotation of the handle, to the wheels, thus adjusting steering angles of the wheels, and allowing the traveling directions of the trunk to be easily changed.

7 Claims, 7 Drawing Sheets

STEERABLE TRAVELING TRUCK

TECHNICAL FIELD

The present invention relates to a traveling trunk which is loaded with luggage and can be dragged, and a steerable traveling trunk which makes it possible to reliably steer wheels by providing a steering function to each wheel via a handle when a user drags a travelling trunk, so a traveling trunk body does not interfere with user's legs and pedestrians walking beside a user and other things, according to which a traveling trunk can move easily, and when a user pushes a traveling trunk, the user can more easily steer the trunk, thus largely enhancing convenience when in use.

BACKGROUND OF THE INVENTION

Over the tens of past years, the demand of a traveling trunk with wheels has increased. A conventional traveling trunk with a horizontal shaft and four wheels is widely used as a representative among many traveling trunks.

The conventional traveling trunk is equipped with four wheels at the bottom of a trunk body and is dragged using a strap or a handle engaged to an end portion of an upper corner of the traveling trunk.

The conventional traveling trunk with four wheels is equipped with a plurality of fixed type wheels at the bottom of a traveling trunk body. The four wheels are spaced apart from one another at a relatively narrow interval, and a pair of leg type wheels support a front end portion of a traveling trunk, so a user can easily drag with the aid of four wheels like a narrow and tall cart.

The conventional traveling trunk with four wheels is not easy to move, so another conventional traveling trunk with two wheels is disclosed.

The conventional traveling trunk is equipped with two wheels which are rotatably engaged to a lower surface of the traveling trunk by attaching a wheel fixing plate using a rivet or screw, and a retractable handle is attached to an upper side of a traveling trunk, thus easily moving the traveling trunk.

The above conventional traveling trunk is equipped with a retractable handle which is pulled out when in use, and when the traveling trunk is tilted forward, the traveling trunk is stably supported by means of two wheels. Namely, the above traveling trunk is directed to moving using two wheels.

When a user drags the above conventional traveling trunk, the conventional traveling trunk sometimes loses its traveling direction, so the traveling trunk interferes with user's walking legs. When the user passes through much crowed people while dragging the traveling trunk, the traveling trunk might collide with other walking people since it repeatedly tilts leftwards and rightwards, so a lot of problems occur when in use.

When a user pushes a conventional traveling trunk, it is hard to make the traveling trunk travel in a right direction, so the traveling trunk might fall down leftwards or rightwards. It is hard for a user to balance the tilting traveling trunk by changing a dragging direction.

SUMMARY OF THE INVENTION

Accordingly, it is an object of the present invention to provide a steerable traveling trunk which makes it possible to reliably steer wheels by providing a steering function to each wheel via a handle when a user drags a travelling trunk, so a traveling trunk body does not interfere with user's legs and pedestrians walking beside a user and other things, according to which a traveling trunk can move easily.

It is another object of the present invention to provide a steerable traveling trunk in which when a user pushes a traveling trunk, the traveling trunk does not fall down leftwards or rightwards by balancing a moving traveling trunk, and a user can easily change a traveling direction of a traveling trunk when in use, thus largely enhancing convenience.

To achieve the above objects, there is provided a steerable traveling trunk which includes a retractable handle at an upper side of a traveling trunk body and a pair of wheels disposed at a lower side of the same which comprises a driving part for converting a horizontal axis rotation of the handle into a vertical axis rotation at both ends of the handle and transferring the rotations as a user rotates the handle; a driving force transfer part which is connected to an upper side of the driving part and transfers the rotational force of the driving part to a lower side of the traveling trunk body and is formed in a retractable structure in the interior of a handle pole part; and an output part which is connected to a lower side of the driving force transfer part and transfers the rotational force transferred via the driving force transfer part depending on the rotation of the handle of the driving part to the wheels in an inclined direction, thus adjusting the steering angles of the wheels in leftward or rightward directions, whereby the traveling directions of the trunk can be easily changed with the aid of the rotation of the handle. With the above features, the present invention is directed to largely enhancing a mobility of a traveling trunk in such a manner that when a user drags, the steerable traveling trunk does not interfere with user's legs or pedestrian walking beside the user and other things, so the user can easily pass through crowed people while dragging a steerable traveling trunk.

In the preferred embodiment of the present invention, the driving part includes a horizontal bar having an outer surface into which a horizontal bar is inserted via a sleeve, and a first bevel gear rotary shaft is formed at both ends of the horizontal bar for inserting and engaging a first bevel gear thereto, respectively, and the first bevel gear is drivingly engaged with the second bevel gear, and the both ends of the handle are engaged to the first bevel gear, so the horizontal axis rotation of the handle is converted to the vertical axis of rotation via the first bevel gear and the second bevel gear. So, the user can easily steer the traveling wheels of the traveling trunk with the aid of the first bevel gear and the second bevel gear while rotating the handle. Since the user can deal with the above operation while moving, the convenience is largely enhanced when in use.

In the preferred embodiment of the present invention, the first bevel gear and the second bevel gear are accommodated in the upper portion of each handle pole part, and driving protrusions protruded from the both ends of the handle are inserted into the back side of the first bevel gear, and the driving protrusions pass through an arc shaped cut-away part formed at a side surface of the handle pole part and are engaged to the back surface of the first bevel gear. When the user rotates the handle, the first bevel rotates, and the rotation direction can be changed with the aid of the first bevel gear, thus steering the traveling direction of wheels.

In the preferred embodiment of the present invention, the arc shaped cut-away parts are symmetrical with respect to the rotary shaft of the first bevel gear and are arranged concentrically, and the first bevel gear rotates on the first bevel gear rotary shaft when the handle rotates. Therefore, the user can rotate the first bevel gear with the aid of the rotation of the handle, thus easily steering the traveling direction of wheels.

In the preferred embodiment of the present invention, the first bevel gear rotary shaft of the horizontal bar is inserted into the through hole of the first bevel gear, and the center shaft of the second bevel gear rotatably passes through the end portion of the first bevel gear rotary shaft from the upper side to the lower side, and the first bevel gear rotating on the first bevel gear rotary shaft rotates the second bevel gear center shaft via the second bevel gear. The first and second bevel gears are engaged with each other and are assembled to a handle pole part in a compact size, so the horizontal axis rotation of the handle can be easily implemented by means of the vertical axis rotation of the center shaft of the bevel gear.

In the preferred embodiment of the present invention, the diameter of the first bevel gear is larger than the diameter of the second bevel gear, so the rotation angle of the second bevel gear center shaft is more largely amplified than the rotation angle of the handle, and the second bevel gear is positioned at an upper side of the first bevel gear at one end portion of the handle, and the second bevel gear is positioned at a lower side of the first bevel gear at the other end portion of the handle, so the second bevel gear center shafts of both sides rotate in the same directions depending on the rotation of the handle. With the above construction, the user can easily change a steering angle of each wheel by rotating a little the handle, so the wheels all change their steering angles in the same directions, which results in an easier traveling direction change of the traveling trunk even while the traveling trunk is being moved.

In the preferred embodiment of the present invention, the driving force transfer part comprises a plurality of straight members of which upper sides are engaged to the second bevel gear center shafts of the driving part, respectively, and a pair of second straight members into which each first straight member is inserted, the first straight members and the second straight members being accommodated along the handle pole part and being formed of polygonal cross sections in the shape shapes, and the vertical axis rotation of the first straight member is transferred to the vertical axis rotation of the second straight member, thus obtaining a retractable structure. Since the driving transfer part is retractable depending on the retractable structure of the handle in the present invention, convenience is largely enhanced when in use.

In the preferred embodiment of the present invention, the output part comprises an upper universal joint of which input side is connected to a lower side of each second straight member of the driving force transfer part; a pair of inclined bars of which upper sides are connected to the output side of the upper universal joint, respectively; and a pair of lower universal joints of which input sides are connected to the lower sides of the inclined bars, respectively, the third bevel gear being connected to the output sides of the lower universal joints, respectively, the third bevel gears being drivingly engaged with the fourth bevel gears which rotate the wheels, thus transferring the rotational force of the driving force transfer part to the wheels, so the wheels change their steering angles in the same direction, respectively. Even when the position of the handle pole part is different from the position of the wheel, the rotational force can be precisely transferred in an inclined state, so various types of traveling trunks can be designed and manufactured.

In the present invention, when a user rotates a handle while dragging a traveling trunk, the rotation force is applied to the output part via the first straight member and the second straight member of the driving force transfer part, respectively, and the output part provides an orientation to each of a pair of wheels via upper and lower universal joints, thus adjusting traveling direction. The user can easily pass through crowed people without the traveling trunk interfering with user's legs and pedestrian walking beside the user and things by changing the traveling directions of the traveling trunk while moving, thus enhancing convenience when in use.

When the user pushes the traveling trunk, the user can easily balance the traveling direction by changing the traveling directions of the traveling trunk, so the traveling trunk does not fall down in the course of movement, and the traveling trunk can be easily balanced by changing the traveling directions of the traveling trunk, which leads to largely improving conveniences when in use.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PRESENT INVENTION

The preferred embodiments of the present invention will be described with reference to the accompanying drawings.

The steerable traveling trunk 100 according to the present invention includes a retractable handle 120 positioned at an upper side of a traveling trunk body 110, and a pair of wheels W1 and W2 are positioned at a lower side of the same.

Figure 1:
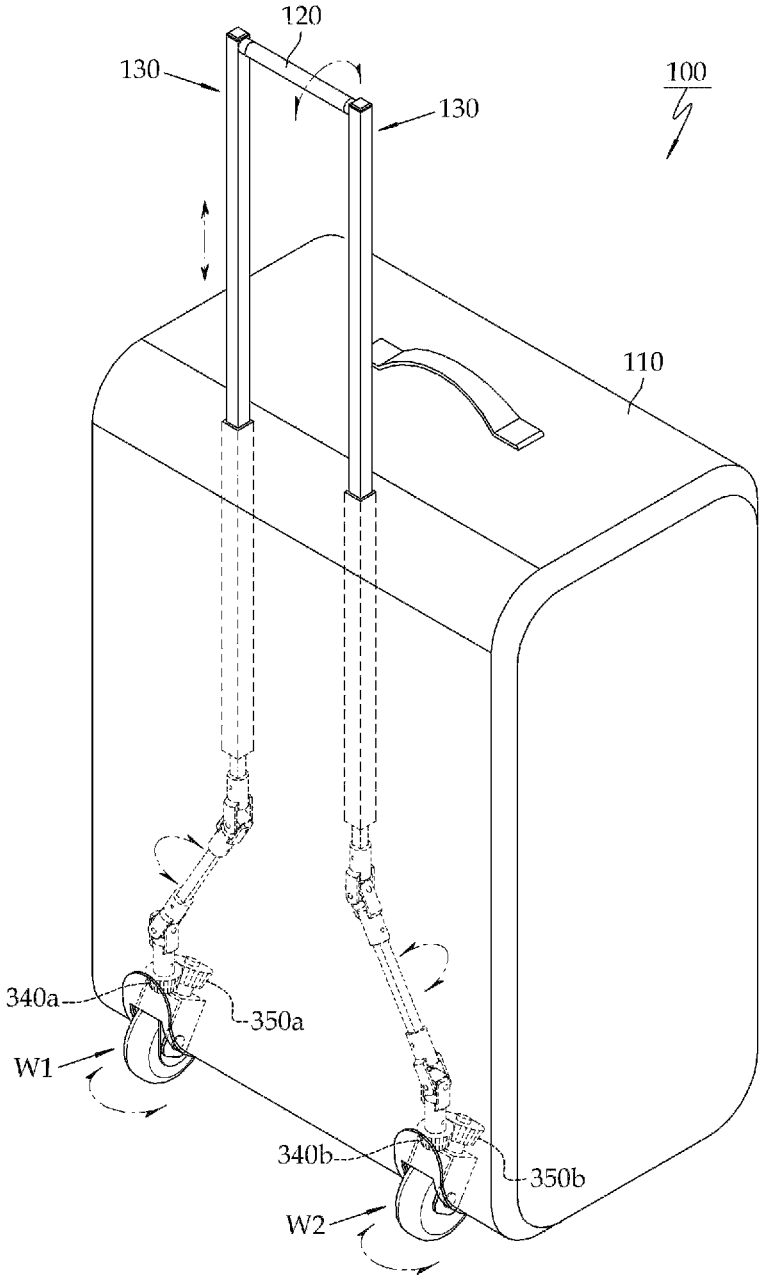
FIG. 1 is a perspective view illustrating a steerable traveling trunk according to the present invention.

As shown in FIG. 1, the steerable traveling trunk 100 according to the present invention also includes a driving part 130 positioned at the handle 120, and when a user rotates the handle 120, the driving part 130 converts a horizontal axis rotation of the handle 120 into a vertical axis rotation at both ends of the handle 120 and transfers the converted force to the lower side of the traveling trunk.

Figure 2:
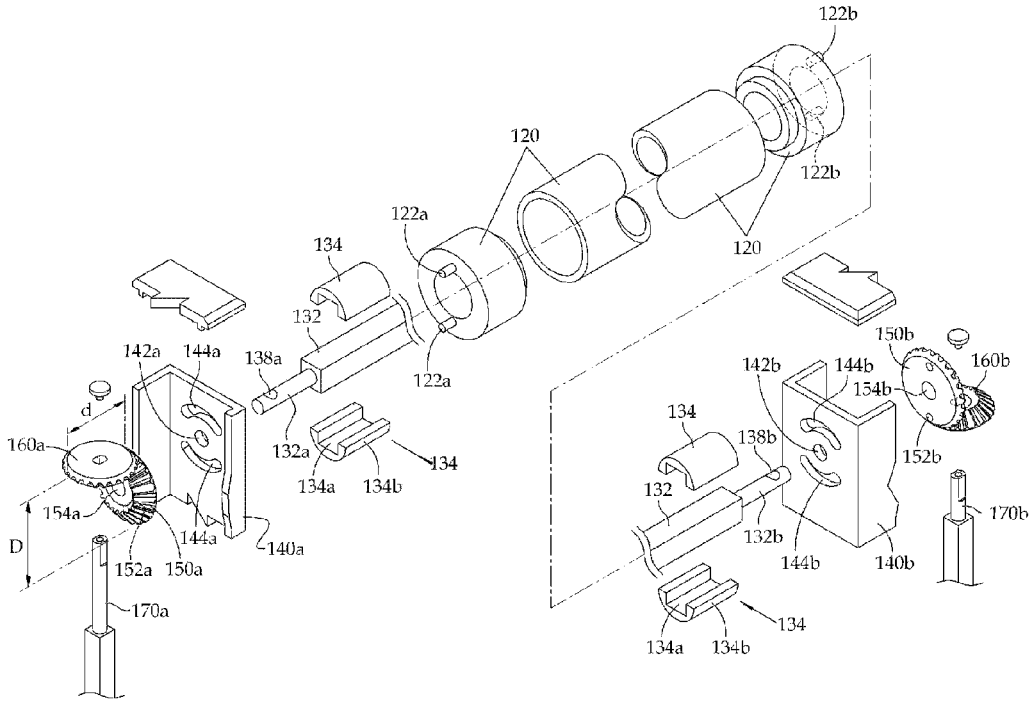
FIG. 2 is a disassembled perspective view illustrating a driving part of a steerable traveling trunk according to the present invention.

As shown in FIG. 2, the handle 120 comprises a horizontal bar 132 rotatably being inserted into an outer surface via a sleeve 134. The horizontal bar 132 is formed in a rectangular cross section structure, first bevel gear rotary shafts 132*a* and 132*b* being protruded from the both ends of the horizontal bar 132.

The sleeve 134 is inserted into both sides of the horizontal bar 132, and the sleeve 134 has a semicircular cross section. The sleeve 134 has a rectangular surface 134*a* correspondingly inserted into the horizontal bar 132, and a circular surface 134*b* formed at its outer surface, while the sleeve 134 surrounds the lower and upper sides of the horizontal bar 132, and the cylindrical handle 120 is rotatably engaged to its outer side.

The first bevel gear rotary shafts 132*a* and 132*b* of the horizontal bar 132 are fixedly inserted into the upper holes 142*a* and 142*b* of the handle pole parts 140*a* and 140*b* positioned at both sides of the handle, respectively. The first bevel gears 150*a* and 150*b* are rotatably inserted into the first bevel gear rotary shafts 132*a* and 132*b* of both sides of the horizontal bar 132.

The first bevel gears 150*a* and 150*b* are drivingly connected with the handle 120, respectively, so when the user rotates the handle 120, the first bevel gears 150*a* and 150*b* rotate on the first bevel gear rotary shafts 132*a* and 132*b*, respectively, for which the holes are formed at the back sides of the first bevel gears 150*a* and 150*b*, with the driving protrusions 122*a* and 122*b* protruded from both sides of the handle 120 being inserted into the holes. The driving protrusions 122*a* and 122*b* pass through the arc shaped cut-away parts 144*a* and 1444*b* formed at the side surfaces of the handle pole parts 140*a* and 140*b* and are engaged to the holes 154*a* and 154*b* of the back sides of the first bevel gears 150*a* and 150*b*.

The arc shaped cut-away parts 144*a* and 144*b* are formed on a concentric circle, which are symmetrical at upper and lower positions about the holes 154*a* and 154*b* into which the first bevel gear rotary shafts 132*a* and 132*b* are inserted, respectively. The driving protrusions 122*a* and 122*b* are engaged to the first bevel gears 150*a* and 150*b* via the arc shaped cut-away parts 144*a* and 144*b*, so when a user rotates the handle 120, the first bevel gears 150*a* and 150*b* rotate on the first bevel rotary shafts 132*a* and 132*b* with the aid of the rotational force transferred via the driving protrusions 122*a* and 122*b*.

Figure 4:
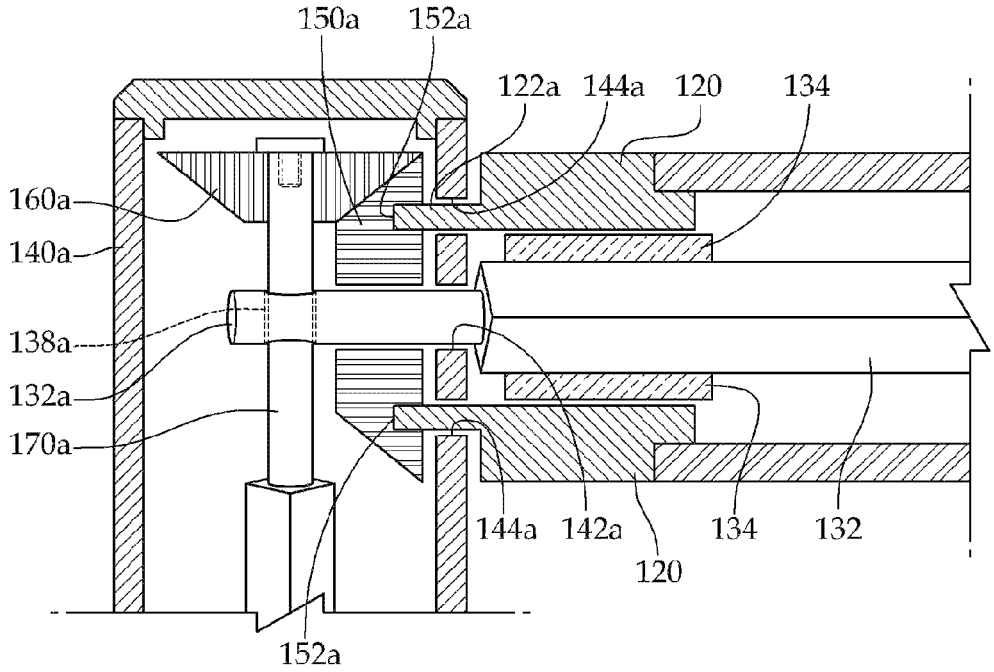
FIG. 4 is an enlarged cross sectional view illustrating an engaged relationship between a first bevel gear and a second bevel gear of a driving part of a steerable traveling trunk according to the present invention.

The second bevel gears 160*a* and 160*b* are engaged with the first bevel gears 150*a* and 150*b*, respectively. As shown in FIGS. 2 and 4, the first bevel gears 150*a* and 150*b* and the second bevel gears 160*a* and 160*b* are all encased in the upper sides of the handle pole parts 140*a* and 140*b*.

The first bevel gear rotary shafts 132*a* and 132*b* of the horizontal bar 132 pass through the back side holes 154*a* and 154*b* of the first bevel gears 150 and 150*b*, and the holes 138*a* and 138*b* into which the second bevel gear center shafts 170*a* and 170*b* are rotatably inserted, are formed at the end portions of the first bevel gear rotary shafts 132*a* and 132*b*, respectively. The second bevel gears 160*a* and 160*b* are integrally fixed at the upper end portions of the second bevel gear center shafts 170*a* and 170*b*, respectively, and then are engaged with the first bevel gears 150*a* and 150*b*.

When the first bevel gears 150*a* and 150*b* rotate on the first bevel gear rotary shafts 132*a* and 132*b*, the second bevel gear center shafts 170*a* and 170*b* rotate therewith via the second bevel gears 160*a* and 160*b*, so consequently the horizontal axis rotation of the handle 120 is converted into the vertical axis rotations of the second bevel gear center shafts 170*a* and 170*b* at both ends.

In the engagement structure of the first bevel gears 150*a* and 150*b* and the second bevel gears 160*a* and 160*b* of the driving part 130, the diameters D of the first bevel gears 150*a* and 150*b* are larger than the diameters d of the second bevel gears 160*a* and 160*b*, so the second bevel gears 160*a* and 160*b* rotating together with the first bevel gears 150*a* and 150*b* have larger rotation angles than those of the first bevel gears 150*a* and 150*b*. Consequently, the rotation angles of the second bevel gear center shafts 170*a* and 170*b* become larger than the rotation angles of the handle 120 connected to the first bevel gears 150*a* and 150*b*.

Figure 3:
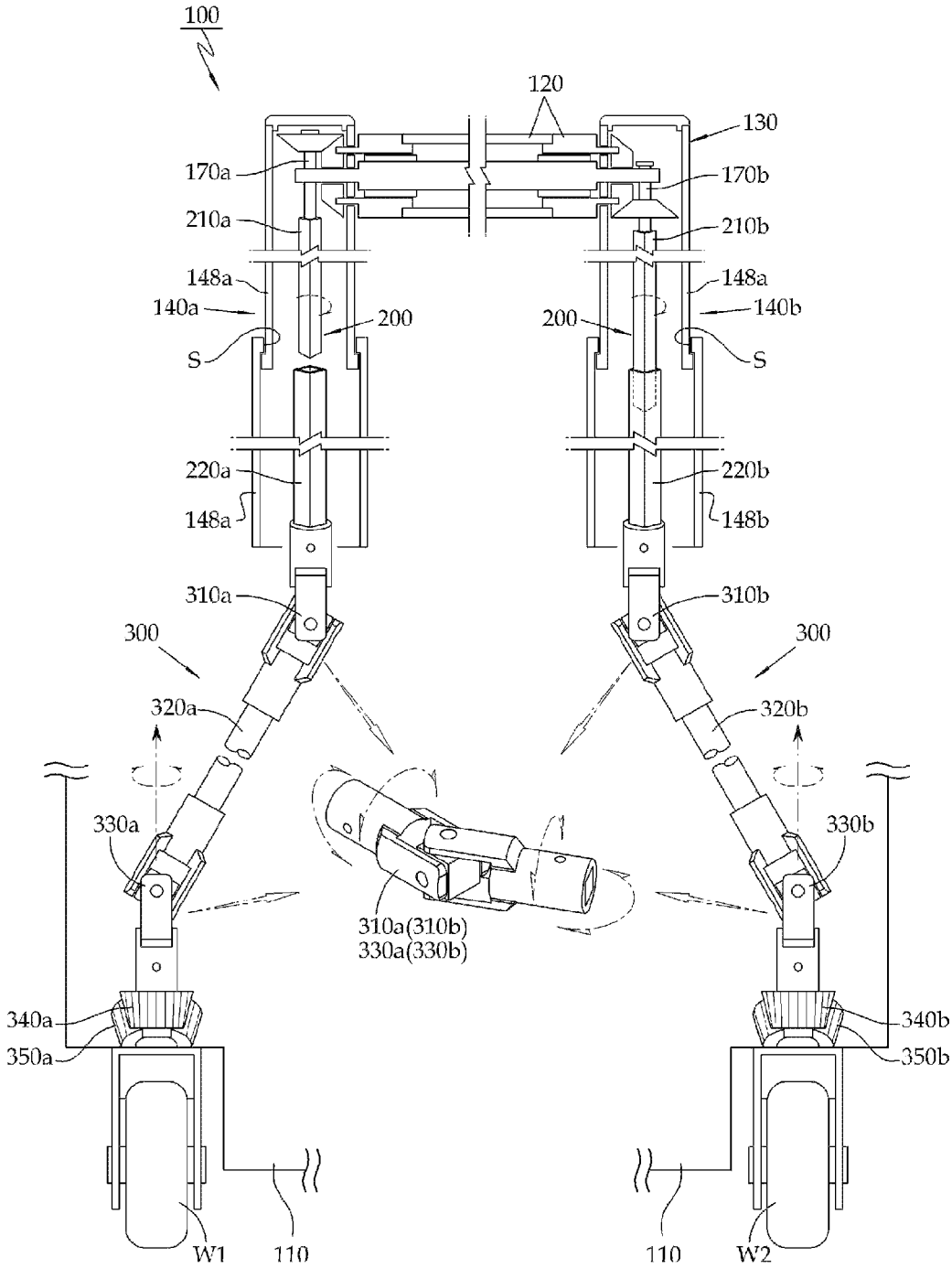
FIG. 3 is a cross sectional view illustrating the entire operations of a driving part, a driving force transfer part and an output part of a steerable traveling trunk according to the present invention.

The second bevel gear center shafts 170*a* and 170*b* of both sides of the same rotate in the same directions depending on the rotation of the handle 120. As shown in FIGS. 2 and 3, the second bevel gear 160*a* is positioned at the upper side of the first bevel gear 150*a* at an upper end portion of the handle 120, and the second bevel gear 160*b* is positioned at a lower side of the first bevel gear 150*b* at the other end portion of the handle 120, and the second bevel gear center shafts 170*a* and 170*b* of both sides rotate in the same directions depending on the rotation of the handle 120.

When a user rotates the handle 120 in the normal direction, the rotational force of the handle 120 is transferred to the second bevel gear center shafts 170*a* and 70*b* via the first bevel gears 150*a* and 150*b* and the second bevel gears 160*a* and 160*b*, respectively.

Figure 5:
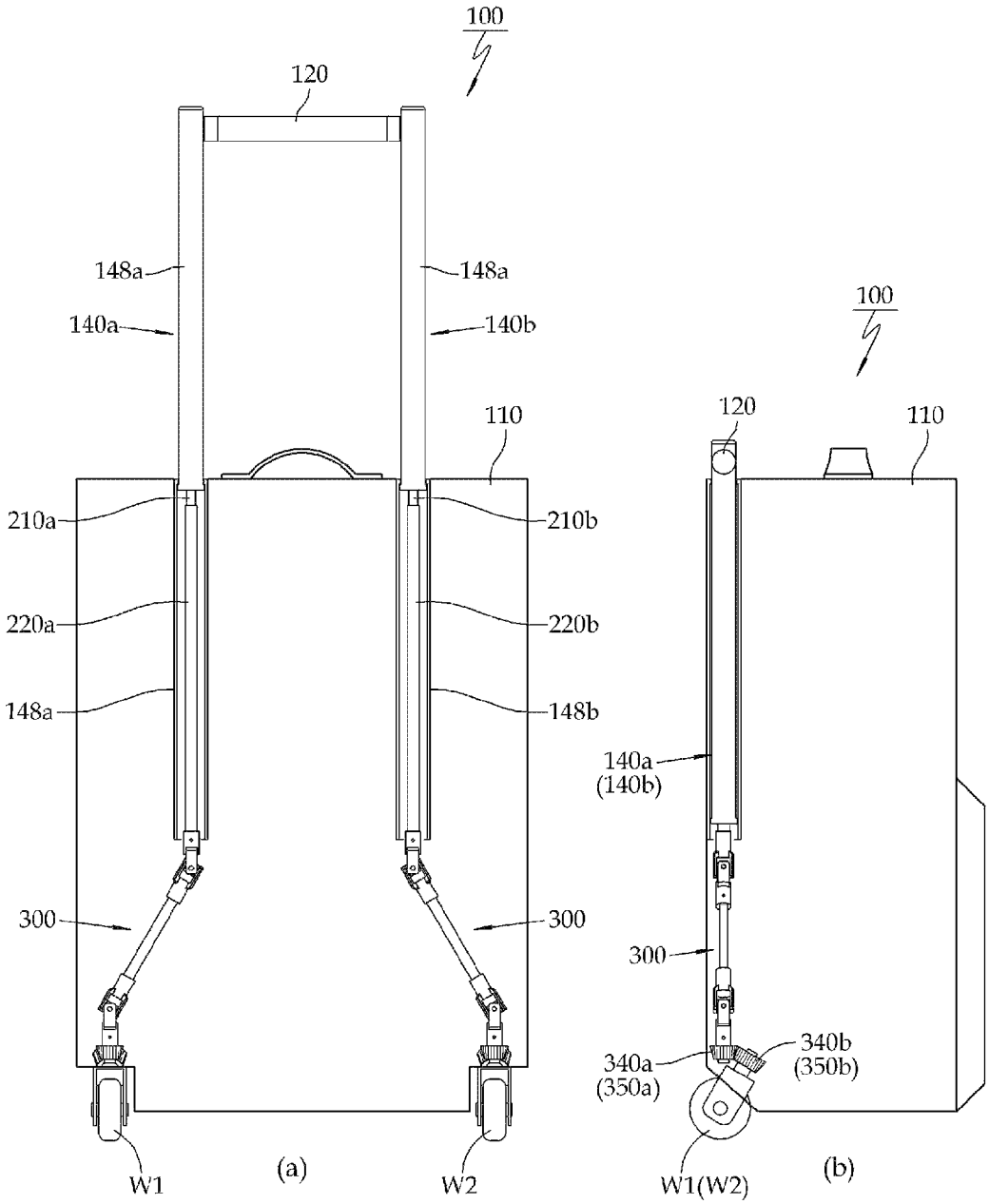
FIG. 5 is a view illustrating a structure that a driving force transfer part of a steerable traveling trunk is retractable depending on a retractable structure of a handle pole part according to the present invention, of which (a) is a view illustrating a state when a handle is extended, and (b) is a side view illustrating a state that a handle is retracted.

In addition, the driving force transfer part 200 is connected to the driving part 130. The driving force transfer part 200 transfers the rotational force of the driving part 130 to the lower side, and as shown in FIGS. 5A and 5B, the interiors of the handle pole parts 140*a* and 140*b* are formed in a retractable structure.

The driving force transfer part 200 comprises a plurality of first straight members 210*a* and 210*b* of which upper end portions are engaged to the second bevel gear center shafts 170*a* and 170*b* of the driving part 130, respectively, and the second straight members 220*a* and 220*b* into which the lower end portions of the first straight members 210*a* and 210*b* are inserted.

As shown in FIG. 3, the first straight members 210*a* and 210*b* and the second straight members 220*a* and 220*b* are internally accommodated along the handle pole parts 140*a* and 140*b* formed in the retractable structures, and are formed to have the same types of polygonal cross sections, and the vertical axis rotations of the first straight members 210*a* and 210*b* are converted into the vertical axis rotations of the second straight members 220*a* and 220*b*, thus obtaining the retractable structure.

The handle pole parts 140*a* and 140*b* each comprise a lower pole 148*b* which is internally accommodated in the hollow upper pole 148*b* of which upper side is connected with the handle 120 and the traveling trunk body 110, with the upper pole 148*a* becoming retractable along the inner side of the lower pole 148*b*, and an engaging shoulder S is formed at a lower end of the upper pole 148*a* and an upper end of the lower pole 148*b*, so the upper pole 148*a* does not escape from the lower pole 148*b*, while maintaining a retractable structure.

Figure 6:
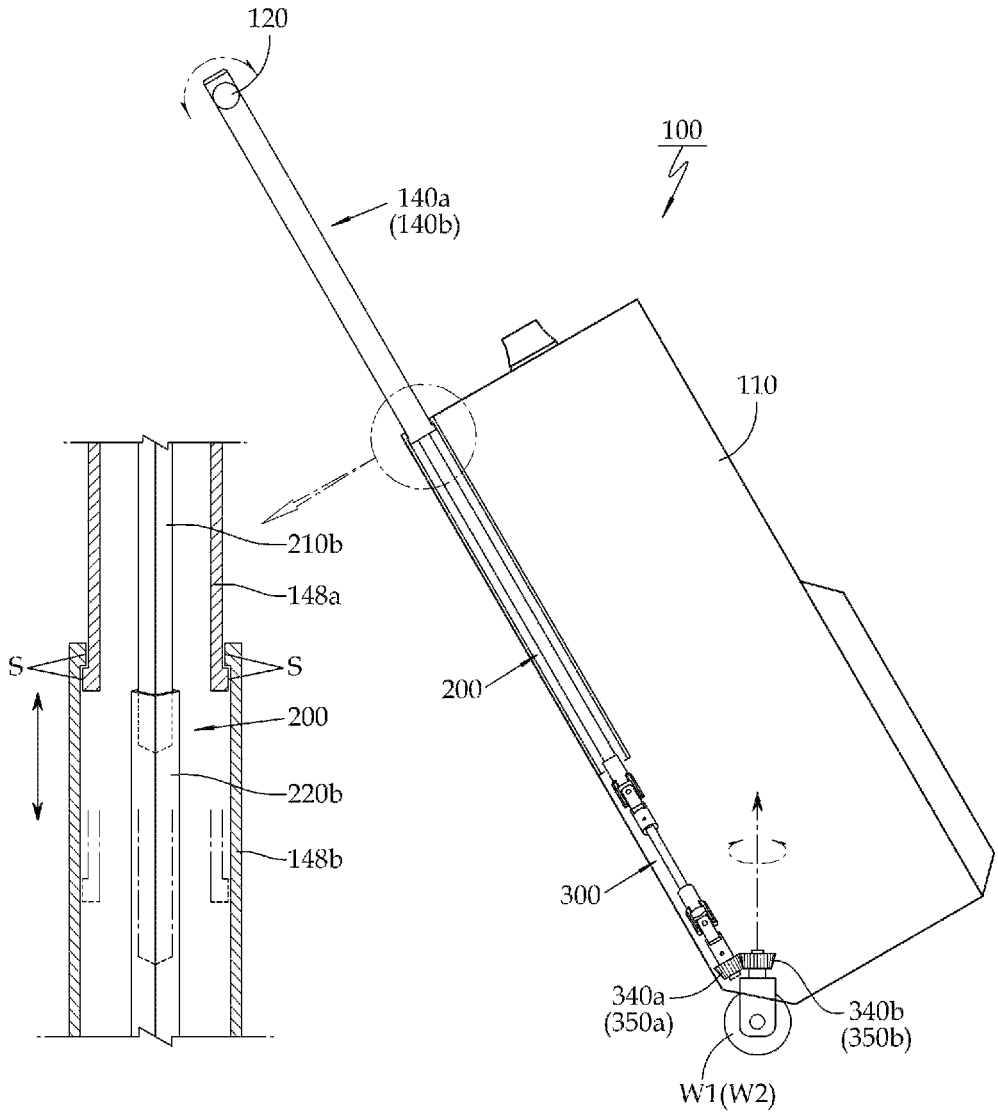
FIG. 6 is a view for describing a state that a driving force transfer part of a steerable traveling trunk is retracted depending on a retractable structure of a handle pole part according to the present invention.

As shown in FIG. 6, the first straight members 210*a* and 210*b* and the second straight members 220*a* and 220*b* accommodated in the handle pole parts 140*a* and 140*b* become retractable depending on the retracting operations of the handle pole parts 140*a* and 140*b*, and the lower end portions of the first straight members 210*a* and 210*b* are inserted into the upper end portions of the second straight members 220*a* and 220*b*, so the lengths are adjustable.

The steerable traveling trunk 100 according to the present invention comprises an output part 300 which is drivingly connected with a lower end portion of the driving force transfer part 200 and transfers the rotational force transferred via the driving force transfer part 200 depending on the rotation of the handle 120 of the driving part 130 to the wheels W1 and W2, thus adjusting the steering angles of the wheels W1 and W2 in the left and right directions, respectively.

As shown in FIG. 3, the output part 300 comprises a pair of upper universal joints 310*a* and 310*b* of which each input side is connected to the lower sides of the second straight members 220*a* and 220*b* of the driving force transfer part 200, respectively, a pair of inclined bars 320*a* and 320*b* of which upper end portions are connected with the output sides of the upper universal joints 310*a* and 310*b*, and a pair of lower universal joints 330*a* and 330*b* of which input sides are connected to the lower sides of the inclined bars 320*a* and 320*b*. In addition, the third bevel gears 340*a* and 340*b* are connected to the output sides of the lower universal joints 330*a* and 330*b*, respectively. The third bevel gears 340*a* and 340*b* are drivingly engaged with the fourth bevel gears 350*a* and 350*b* which rotate the wheels W1 and W1, respectively. The third bevel gears 340*a* and 340*b* and the fourth bevel gears 350*a* and 350*b* receive the rotational force from the driving force transfer part 200, thus rotating the wheels W1 and W2.

Figure 7:
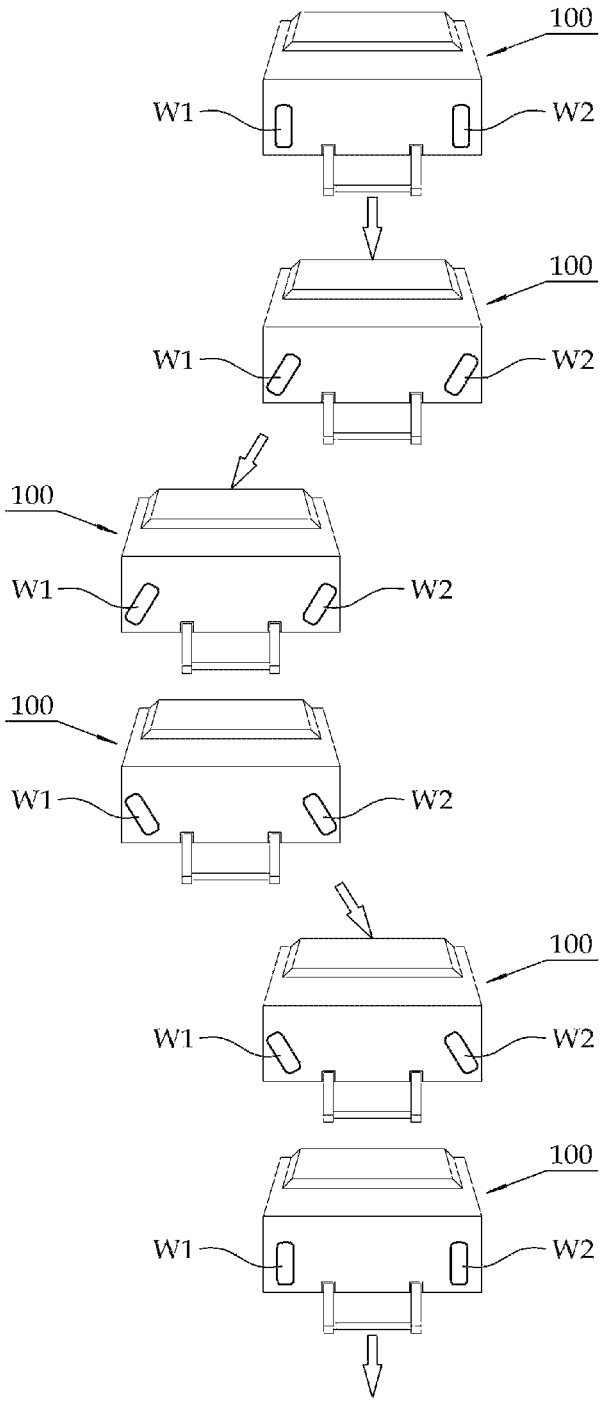
FIG. 7 is a view for describing a state that a steerable traveling trunk moves while a traveling direction is being changed depending on a steering angle change of a wheel of a steerable traveling trunk according to the present invention.

The steerable traveling trunk 100 according to the present invention makes it possible to steer a traveling direction of the traveling trunk 100, as shown in FIG. 7, by pulling up the handle 120 from the traveling trunk body 110 while moving.

When the handle 120 is positioned at the center, the wheels W1 and W2 rotatably engaged to the lower sides of the traveling trunk body 110 face forwards, and when the traveling trunk body 110 is pulled by holding the handle 120, the traveling trunk is pulled forwards.

In the course of the above operation, when it is needed to change the traveling direction of the traveling trunk body 110 to the leftward direction, the handle 120 is rotated in the normal direction, so the wheels W1 and W2 orient leftwards. The wheels W1 and W2 all change their steering angles in the same directions, namely, in the leftward direction with the aid of the rotational force of the handle 120 of the driving pat 130. In this case, the first bevel gears 150*a* and 150*b* of both sides rotate on the first bevel gear rotary shafts 132*a* and 132*b* depending on the rotations of the handle 120, thus rotating the engaged second bevel gears 160*a* and 160*b* in the normal directions. So, the second bevel gear center shafts 170*a* and 170*b* connected with the second bevel gears 160*a* and 160*b* all rotate in the normal directions, and the first straight members 210*a* and 210*b* and the second straight members 220*a* and 220*b* of the driving force transfer part 200 connected to the second bevel gear center shafts 170*a* and 170*b* all rotate thereby. The upper universal joints 310*a* and 310*b* and the inclined bars 320*a* and 320*b* and the lower universal joints 330*a* and 330*b* of the output part 300 all rotate the wheels W1 and W2 in the vertical directions by a certain angle and make them to face leftwards with the aid of the third bevel gears 340*a* and 340*b* and the fourth bevel gears 350*a* and 350*b*, respectively.

When the wheels W1 and W2 all face leftwards, the user pulls the wheels W1 and W2 via the handle 120, the traveling trunk body 110 moves leftwards, thus steering leftwards.

In the above state, when the handle 120 is rotated in the opposite direction, the first bevel gears 150*a* and 150*b* of both sides rotate in the reverse direction on the first bevel gear rotary shafts 132*a* and 132*b*, and the second bevel gears 160*a* and 160*b* engaged thereto all rotate in the reverse direction.

In addition, the second bevel gear center shafts 170*a* and 170*b* connected with the second bevel gears 160*a* and 160*b* all rotate in the reverse directions. The first straight members 210*a* and 210*b* and the second straight members 220*a* and 220*b* of the driving force transfer part 200 connected to the second bevel gear center shafts 170*a* and 170*b* rotate thereby, and the upper universal joints 310*a* and 310*b* and the inclined bars 320*a* and 320*b* and the lower universal joints 330*a* and 330*b* of the output part 300 allow the wheels W1 and W2 to face rightwards with the aid of the third bevel gears 340*a* and 340*b* and the fourth bevel gears 350*a* and 350*b*, respectively.

In a state that the wheels W1 and W2 face rightwards, when a user pulls the wheels W1 and W2 via the handle 120, the traveling trunk body 110 moves rightwards, thus moving in a desired direction. When the user rotates the handle 120 to its original position, the wheels W1 and W2 face forwards at the lower side of the traveling trunk body 110, so that the traveling trunk body 110 can be pulled in a forward direction.

While a user is dragging the traveling trunk 100 according to the present invention, when the user rotates the handle 120, the horizontal axis rotation is converted into the vertical axis rotation with the aid of the first bevel gears 150*a* and 150*b* and the second bevel gears 160*a* and 160*b*, and the rotational force is transferred to the driving force transfer part 200 and is transferred to the output part 300 via the first straight members 210*a* and 210*b* and the second straight members 220*a* and 220*b*, and the output part 300 gives a certain orientation to the wheels W1 and W2 via the upper and lower universal joints 330*a* and 330*b* and the third bevel gears 340*a* and 340*b* and the fourth bevel gears 350*a* and 350*b*, respectively.

Walking or moving, the user can easily drag the traveling trunk without interfering with user's legs or pedestrian walking beside the user or other things with the aid of the reliable traveling direction change of the traveling trunk 100, thus enhancing convenience when in use of the traveling trunk.

When the user pushes the traveling trunk 100, the traveling trunk 100 does not easily fall down with the aid of the traveling direction change with the aid of the handle 120 while easily balancing the traveling of the trunk and changing the moving direction, which results in both an easier use and enhancing convenience.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A steerable traveling trunk which includes a retractable handle at an upper side of a traveling trunk body and a pair of wheels disposed at a lower side of the same, comprising:

a driving part for converting a horizontal axis rotation of the handle into a vertical axis rotation at both ends of the handle and transferring the rotations as a user rotates the handle;

a driving force transfer part which is connected to an upper side of the driving part and transfers the rotational force of the driving part to a lower side of the traveling trunk body and is formed in a retractable structure in the interior of a handle pole part; and an output part which is connected to a lower side of the driving force transfer part and transfers the rotational force transferred via the driving force transfer part depending on the rotation of the handle of the driving part to the wheels in an inclined direction, thus adjusting the steering angles of the wheels in leftward or rightward directions, wherein said driving force transfer part comprises a pair of first straight members of which upper sides are engaged to one of a pair of second bevel gear center shafts of the driving part, respectively, and a pair of second straight members into which each first straight member is inserted, and both the first and second straight members being formed of polygonal cross sections, and the vertical axis rotation of the first straight member is transferred to the vertical axis rotation of the second straight member.

2. The traveling trunk of claim 1, wherein said driving part includes a horizontal bar having an outer surface into which the handle is inserted via a sleeve, and a first bevel gear rotary shaft is formed at both ends of the horizontal bar for inserting and engaging a first bevel gear thereto, respectively, and the first bevel gear is drivingly engaged with a second bevel gear, and the both ends of the handle are engaged to the first bevel gear, so the horizontal axis rotation of the handle is converted to the vertical axis rotation via the first bevel gear and the second bevel gear.

3. The traveling trunk of claim 2, wherein said first bevel gear and said second bevel gear are accommodated in the upper portion of each handle pole part, and driving protrusions protruded from the both ends of the handle are inserted into the back side of the first bevel gear, and the driving protrusions pass through an arc shaped cut-away part formed at a side surface of the handle pole part and are engaged to the back surface of the first bevel gear.

4. The traveling trunk of claim 3, wherein said arc shaped cut-away parts are symmetrical with respect to a first bevel gear rotary shaft and are arranged concentrically, and the first bevel gear rotates on the first bevel gear rotary shaft-when the handle rotates.

5. The traveling trunk of claim 2, wherein said first bevel gear rotary shaft of the horizontal bar is inserted into a through hole of the first bevel gear, and a second bevel gear center shaft rotatably passes through the end portion of the first bevel gear rotary shaft from the upper side to the lower side, and the first bevel gear rotating on the first bevel gear rotary shaft rotates the second bevel gear center shaft via the second bevel gear.

6. The traveling trunk of claim 5, wherein the diameter of the first bevel gear is larger than the diameter of the second bevel gear, so the rotation angle of the second bevel gear center shaft is more largely amplified than the rotation angle of the handle, and the second bevel gear is positioned at an upper side of the first bevel gear at one end portion of the handle, and the second bevel gear is positioned at a lower side of the first bevel gear at the other end portion of the handle, so the second bevel gear center shafts of both sides rotate in the same directions depending on the rotation of the handle.

7. The traveling trunk of claim 1, wherein said output part comprises:

an upper universal joint of which input side is connected to a lower side of each second straight member of the driving force transfer part;

a pair of inclined bars of which upper sides are connected to the output side of the upper universal joint, respectively; and a pair of lower universal joints of which input sides are connected to the lower sides of the inclined bars, respectively, a third bevel gear being connected to the output sides of the lower universal joints, respectively, said third bevel gears being drivingly engaged with a fourth bevel gears which rotate the wheels, thus transferring the rotational force of the driving force transfer part to the wheels, so the wheels change their steering angles in the same direction, respectively.

* * * * *